US006841324B2

(12) United States Patent
Bartscher et al.

(10) Patent No.: US 6,841,324 B2
(45) Date of Patent: Jan. 11, 2005

(54) ELASTOMERIC IMAGE CARRIER WITH CAVITIES

(75) Inventors: Gerhard Bartscher, Cologne (DE); Christoph König, Lindlar (DE)

(73) Assignee: Felix Boettcher GmbH & Co. KG, Cologne (DE)

( * ) Notice: Subject to any disclaimer, the term of this patent is extended or adjusted under 35 U.S.C. 154(b) by 15 days.

(21) Appl. No.: 10/125,643

(22) Filed: Apr. 19, 2002

(65) Prior Publication Data

US 2002/0160288 A1 Oct. 31, 2002

(30) Foreign Application Priority Data

Apr. 19, 2001 (DE) ..... 101 19 074

(51) Int. Cl.[7] ..... G03G 5/047
(52) U.S. Cl. ..... 430/56; 430/59.6
(58) Field of Search ..... 430/56, 59.6

(56) References Cited

U.S. PATENT DOCUMENTS

| | | | | |
|---|---|---|---|---|
| 3,399,060 A | | 8/1968 | Clancy | |
| 4,587,191 A | * | 5/1986 | Clark | 430/56 |
| 4,601,963 A | | 7/1986 | Takahashi et al. | 430/69 |

FOREIGN PATENT DOCUMENTS

| | | |
|---|---|---|
| DE | 34 14 298 | 10/1984 |
| JP | 62 157045 | 7/1987 |
| JP | 07 152285 | 6/1995 |
| JP | 11 052791 | 2/1999 |

* cited by examiner

*Primary Examiner*—Mark A. Chapman
(74) *Attorney, Agent, or Firm*—Jacobson Holman

(57) ABSTRACT

The present invention relates to an image carrier, for example, for use in electro-photography, containing at least one elastomer with cavities. The image carrier can be used, inter alia, in electrography, electrophotography (as a photoconductor) or magnetography and in color printing processes.

11 Claims, 1 Drawing Sheet

ELASTOMERIC IMAGE CARRIER WITH CAVITIES

Figure 1:
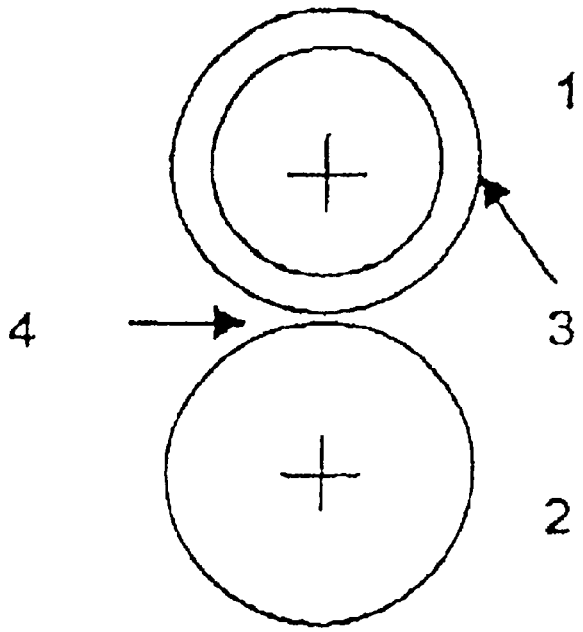
Fig. 1 Prior Art

The present invention relates to an image carrier which contains at least one elastomer with cavities. The image carrier can be used, inter alia, in electrography, electrophotography or magnetography.

Digital printing methods have increasingly gained importance in recent years, especially in electrophotography. Although most of the devices still work in black and white only, the proportion of color devices keeps increasing. For color devices, there are essentially higher demands on image quality as compared to black and white devices.

A central component in electrophotographic printing methods is the photoconductor. Today, in virtually all electrophotographic color printers, organic photoconductors are employed. The thickness of the photoconductor is typically about 20 $\mu$m on a drum made of aluminum. Usually, the photoconductor is neither elastic nor compressible. A detailed description of the electrophotographic process is found, for example, in "Electrophotography and Development Physics" by L. B. Schein, Springer Verlag, 1992, ISBN 0-387-55858-6.

To achieve a good image quality as required in color printing, intermediate carriers are often employed in electrophotographic color printers. When an intermediate carrier is used, the toner image is transferred from the photoconductor first onto the intermediate carrier and from there onto paper. These intermediate carriers are in part elastic and/or compressible, so that uneven features of the rough paper are counterbalanced. Such intermediate carriers are employed, for example, in the following commercially available electrophotographic printers:

DocuColor 2060 of Xerox: as the intermediate carrier, a continuous tape is employed through electrostatic transfer.

NexPress 2100 of NexPress: intermediate carriers are drums (also electrostatic transfer).

E-Print 1000 of Indigo: The intermediate carrier is a kind of printing blanket which is tentered onto a cylinder. The transfer onto paper is effected through pressure and heat.

Such intermediate carriers improve the image quality, but also have considerable drawbacks:

Thus, being additional components and wearing parts, they cause considerable costs for each printed page and increase the complexity of the machine. In addition, color printers typically work with the four process colors black, cyan, magenta and yellow, which are applied successively to the paper (or the intermediate carrier). A high quality image requires a registering accuracy of 100 $\mu$m or more between the color separations. Achieving this accuracy is rendered more difficult by an intermediate carrier.

U.S. Pat. No. 3,945,723 describes a technique in which a flexible layer under a photoconductor sleeve is pressurized through two end pieces, so that the photoconductor sleeve becomes attached thereto.

U.S. Pat. No. 3,994,726 describes a flexible photoconductor. The flexibility is required to achieve a broad contact zone for a special form of liquid development.

U.S. Pat. No. 5,828,931 and the corresponding DE 19646348-A1 suggest an elastic layer under a photoconductor to achieve a better image quality without an intermediate carrier. In particular, the hardness of the elastic and photoconductive layers is specified, the photoconductor being harder than the elastic layer.

As compared to the previously known systems, according to U.S. Pat. No. 5,828,931, a good image quality (the elastic photoconductor conforms well to the rough paper) as well as a simplified set-up of machine and a cost reduction from the omission of the intermediate carrier are achieved.

However, in this solution, there is a problem for those systems in which the four process colors are successively transferred onto paper in four printing stations: elastic materials exhibit a so-called deformation slip. This is an effect which is further illustrated by reference to FIG. 1: Roller 1 has an elastomeric lining 3 (for example, of rubber) and bears upon roller 2. Roller 2 and the core of roller 1 are made of a material which is not elastic (for example, steel) as compared with lining 3. Due to the bearing relationship, a contact zone 4 is formed, also referred to as a nip, in which the elastomeric lining is deformed. Now, when roller 1 is driven so that roller 2 is moved by roller 1 through friction, a higher surface speed can be observed for the hard roller 2 as compared with roller 1 having the elastomeric lining. This effect is referred to as a positive deformation slip. It is produced essentially due to the fact that elastic materials, such as rubber or polyurethane, are not compressible, but are pressed through a nip which is smaller than the thickness of the lining. In principle, the positive deformation slip increases with the strength with which the two rollers are pressed together. In addition, the positive deformation slip decreases with increasing thickness of the lining.

This deformation slip has unfavorable effects in color printing according to the method of U.S. Pat. No. 5,828,931, as illustratively shown in FIG. 2 for a printing process for two colors: Rollers 5*a* and 5*b* are photoconductors according to U.S. Pat. No. 5,828,931. Through known means not represented here, a toner image of the first color is produced on photoconductor 5*a*, and an image of the second color is produced on photoconductor 5*b*. Paper 7 runs in the direction of arrow 8 and is first pressed against photoconductor 5*a* by back-up roll 6*a*, so that the image of the first color is transferred onto the paper. Subsequently, the paper is pressed against photoconductor 5*b* by back-up roll 6*b*, to transfer the second color onto the paper.

A problem arises from the exact mutual positioning of the two color images, especially from the deformation slip and work tolerance in the production of photoconductors 5*a* and 5*b*. For a good image quality, the registering accuracy must be 100 $\mu$m or better (i.e., more accurate). In addition, this must be achieved throughout the paper surface. Under typical conditions, the deformation slip is about 1%. For a sheet of length A4 (29.7 cm), this corresponds to a length difference of 2970 $\mu$m, which is considerably more than the desired 100 $\mu$m. According to the prior art, three techniques are used to minimize the deformation slip: When the pressing force is known, the deformation slip can be measured. To the extent to which the deformation slip extends the image, the image is shortened when applied to the photoconductor, so that the image transferred onto the paper has the right length. As a second technique for reducing registering errors, the same bearing pressure is selected for back-up rolls 6*a* and 6*b*, i.e., back-up roll 6*a* is set to bear upon photoconductor 5*a* with the same force as in the bearing of set-up roll 6*b* against photoconductor 5*b*. The third possibility of correction is to provide the lining with as thick as possible a design, since the positive deformation slip is kept relatively small thereby.

Despite of these correction mechanisms, it is very difficult to achieve the desired registering accuracy. In practice, it is generally impossible to achieve exactly the same bearing pressure for all (typically four) colors. Small differences in the bearing pressure already lead to considerable registering errors. Another essential source of errors is the work tolerance of the photoconductors according to U.S.

Pat. No. 5,828,931. The preparation of a highly precise roller with an elastomeric lining is complicated and causes high costs. Further, linings having a high thickness (typically 1 cm or more) are required, which results in large and heavy rollers. In practice, this is of considerable disadvantage since the photoconductor is a wearing part which must be replaced relatively often (e.g., after 50,000 A4 pages). Accordingly, this component must be both inexpensive and easily handled for replacement.

It has been the object of the invention to provide an image carrier which exhibits no or a very low deformation slip so that the problem of registering accuracy and the related drawbacks is overcome. The image carrier according to the invention should also be suitable as a photoconductor.

Surprisingly, the above object is achieved by an image carrier which contains at least one elastomer with cavities.

Said elastomer is preferably a foamed polymer, especially a foamed polyurethane, silicone, EPDM rubber and/or NBR. "Foamed" as used herein means, for example, that the polymer is prepared in such a way that a gas, for example, nitrogen or $CO_2$, is released in the preparation process. Alternatively, the gas may also be introduced during the preparation of the polymer. In both cases, an elastomer is formed which contains cavities and has a relatively low density.

In a further preferred embodiment, the cavities in the elastomer are produced by introducing expanded bubbles or non-expanded bubbles which are subsequently being expanded. The elastomers include, in particular, the above mentioned materials polyurethane, silicone, EPDM rubber and/or NBR. Such polyurethane-based systems are described in the German patent application DE 10111618.7. The thermoplastic bubbles are preferably made of an acrylate-vinylidene fluoride copolymer and contain a gas, for example, butane.

The volume fraction of cavities in the elastomer is preferably from 5 to 95%, especially from 20 to 80%. The ratio of cavities to elastomeric material can be optimized simply by minimizing the deformation slip. If the elastomer with the cavities has further components, such as a photoconductive or magnetic material, then the volume fraction of cavities in the material which contains the elastomer and the additives is preferably from 5 to 95%, especially from 20 to 80%.

In a preferred embodiment, the image carrier is a photoconductor. The photoconductor according to the invention is preferably provided in one of the following embodiments:

On the one hand, it may have at least two layers of which at least one layer has photoconductive properties and at least one layer contains an elastomer with cavities. On the other hand, it may contain a layer which contains an elastomer with cavities and at the same time has photoconductive properties.

For example, in a first embodiment, a photoconductive layer is applied to an elastomeric layer having a thickness of 1 mm and a relatively low specific resistivity (e.g., lower than $10^9$ Ωm) which consists of polyurethane which contains expanded bubbles. In contrast, in the second embodiment, the elastomeric layer with the cavities has itself photoconductive properties.

The photoconductors according to the invention have the following advantages over known photoconductors: Non-foamed or, generally, incompressible elastomers exhibit a positive deformation slip when set to bear upon a hard roller (i.e., the hard roller rotates faster than the elastomeric roller), while compressible materials exhibit a negative deformation slip (i.e., the hard roller rotates more slowly than the elastomeric roller).

In contrast, when the materials according to the invention are used, a deformation slip is usually completely avoided by appropriately selecting the ratio of cavities to elastomer. Thus, a high registering accuracy is achieved which substantially independent of both the bearing pressure of the back-up rolls for the different colors in the electrostatic transfer from the photoconductor onto the paper, and work tolerances (for example, concentricity). Due to the high registering accuracy, an extraordinarily good image quality in the transfer is achieved.

This is accompanied by a low consumption of elastomeric material (as compared, for example, with a photoconductor according to U.S. Pat. No. 5,828,931). In the photoconductors according to the invention, this is achieved in several respects. First, the introduction of cavities saves material. Second, in a material according to the invention which does not exhibit any deformation slip, it is not necessary to provide the lining with a particularly thick design to minimize the deformation slip, as is the case when materials with no cavities are used. Third, in materials with cavities, it is considerably easier to achieve a low Shore hardness. This is advantageous because a relatively broad nip is formed already with a low bearing pressure. A relatively broad nip of typically several millimeters is very advantageous in electrophotography in the electrostatic transfer from the photoconductor onto the paper. The low consumption of the elastomeric material has advantages, inter alia, in that lower costs are incurred and that a simplified replacement of the photoconductor becomes possible.

In one example of the above described first embodiment, the elastomeric layer with the cavities has a thickness of 1 mm. The layer has a Shore A hardness of 20 and a specific resistivity of $10^8$ Ωm. This value holds for a speed range of up to about 0.5 m/s. For higher speeds, a lower specific resistivity is required, which in a first approximation is inversely proportional to the speed. The structure of the photoconductor is in a first approximation similar to that of conventional photoconductor drums, i.e., the elastomeric layer is coated with a barrier layer having a thickness of less than 1 μm, which is again coated with a charge-carrier generation layer having a thickness of about 1 μm (where charge carriers are generated by impinging light), finally coated with a charge-carrier transport layer having a thickness of about 20 μm as the topmost layer. Optionally, a thin (e.g., having a thickness of about 3 μm) and hard wear-protection layer may be applied to the topmost layer. Evidently, the number of layers can be reduced when one of the mentioned layers adopts several functions.

For these 3 layers, or 4 layers when a wear-protection layer is used, a wide variety of materials are available today (see, for example, ""Electrophotography and Development Physics" by L. B. Schein, Springer Verlag, 1992, ISBN 0-387-55858-6, or DE 19951522). For the photoconductors according to the invention, those materials are preferred which are flexible in order to withstand bends and loads occurring in the passage through the nip without a damage. Accordingly, organic photoconductors are preferred over harder and thus less flexible inorganic photo-conductors.

In the photoconductors according to the invention having no deformation slip, it is advantageous to optimize the ratio of cavities to elastomeric material. When the proportion of cavities is too high, a negative deformation slip is obtained, while too low a proportion of cavities results in a positive deformation slip. The proportion of cavities required to avoid deformation slip depends, in particular, on the type and hardness of the elastomer employed. In particular, it varies between 5 and 95%.

As the base for applying the elastomeric layer, various objects are used in the prior art: a solid drum, a rigid sleeve (e.g., aluminum having a wall thickness of 1 mm), a flexible sleeve (e.g., stainless steel having a wall thickness of 50 $\mu$m), or a flexible tape (for example, PET having a thickness of 100 $\mu$m). For the adhesion of the elastomeric layer on the substrate, adhesion promoters may be employed.

In a preferred embodiment of the invention, no substrate is used. The photoconductor is then prepared as a sleeve in the above described shape, for example, on a drum and subsequently peeled off again. This has the advantage of low costs, since a substrate can be saved. As already mentioned, the photoconductor is a wearing component which has to be replaced relatively frequently (e.g., after 50,000 A4 pages), so that costs play an important role here. In order to ensure a good electric contact to the receiving drum in the printing machine in this embodiment (which is indispensable for the functioning of the photoconductor), two embodiments are preferred: First, a comparably low specific resistivity of the elastomeric material (e.g., lower than $10^7$ $\Omega$m) or, second, a "highly conductive" coating in the interior of the sleeve (example: a graphite layer of about 1 $\mu$m thickness).

In another preferred embodiment, the bending radius for the photoconductor is kept as large as possible. Thus, loads on the photoconductive materials are kept as low as possible. For a drum, this can be achieved, for example, by a large exterior diameter (example: 200 mm). For a tape, this can be achieved by a sufficient length and an appropriate guiding of the tape.

As described above, in a preferred embodiment of the invention, the layer which contains the elastomer and the cavities also contains the photoconductor. The elastomeric layer is then the transport layer for the charge carriers. In this case, the following structure is possible, for example: A barrier layer having a thickness of less than 1 $\mu$m is coated onto the substrate. This is coated with the elastomeric layer having a thickness of about 1 mm, which simultaneously serves as the transport layer for the charge carriers. This is followed by the generation layer (having a thickness of about 1 $\mu$m). Since such layers typically withstand only low mechanic loads (heavy wear in contact with paper), a wear-protection layer as described above is used here.

Generally, the advantages of the image carrier according to the invention as described above are also achieved in embodiments in which the image carrier is not a photoconductor. The image carrier according to the invention is preferably also used for electrography and magnetography. In electrography (or ionography, as described in "Electrophotography and Development Physics" by L. B. Schein, Springer Verlag, 1992, ISBN 0-387-55858-6), an electrically insulating layer is used rather than a photoconductor. The present invention can be employed here with the same advantages as with a photoconductor. Alternatively, an insulating coating can also be dispensed with by using a highly insulating material for the elastomeric material.

The same applies to magnetography (as described in "Electrophotography and Development Physics" by L. B. Schein, Springer Verlag, 1992, ISBN 0-387-558586). Here, a magnetic layer is used rather than a photoconductive layer. Alternatively, one or more magnetic materials (e.g., magnetite) can be incorporated in the elastomeric material. Except for the mentioned printing methods (electrophotography, electrography, magnetography), the image carrier according to the invention may also be employed in any other printing method in which a toner image is produced on an image carrier and transferred from there onto the printing substrate without an intermediate carrier, especially in color printing.

In a further variant, the transfer is effected thermally, i.e., the toner is heated to melt and stick on the paper upon contact therewith. This has two advantages: First, the steps of transfer and fixing are combined in one step, which simplifies the process. Second, some errors which may occur in electrostatic transfer are avoided in this variant. For this variant, the elastomeric and photoconductive layers must be sufficiently temperature-stable. In addition, a material having a low surface energy is employed for the topmost layer, so that the molten toner is readily detached from the photoconductor for transfer onto the paper.

FIGURES

FIG. 1: Scheme of an arrangement for electrophotographic printing according to the prior art.

Figure 2:
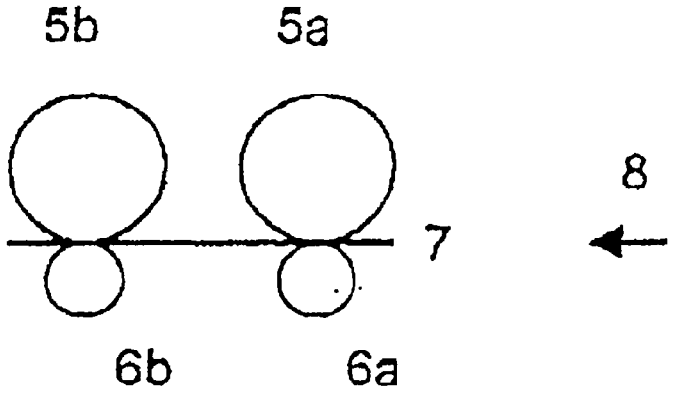
Fig. 2 Prior Art

FIG. 2: Scheme of an arrangement for an electrophotographic printing process for two colors according to the prior art.

What is claimed is:

1. An image carrier comprising (a) at least one elastomer with cavities of gas filled, expanded thermoplastic bubbles (b) in a form selected from the group consisting of a solid drum, a rigid sleeve, a flexible sleeve, and a flexible tape.

2. The image carrier according to claim 1, characterized in that the volume fraction of cavities in the elastomer is from 5 to 95%, preferably from 20 to 80%.

3. The image carrier according to claim 1, characterized in that the elastomer is a foamed polymer, especially a polyurethane, silicone, EPDM rubber and/or NBR.

4. The image carrier according to claim 1, characterized in that the elastomer is a polyurethane.

5. The image carrier according to claim 4, characterized in that said thermoplastic bubbles are made of an acrylate-vinylidene fluoride copolymer.

6. A photoconductor for use in electrophotography comprising the image carrier according to claim 1 and characterized by containing at least two layers, at least one layer having photoconductive properties and at least one layer containing the elastomer with cavities.

7. The photoconductor for use in electrophotography according to claim 6, characterized in that the layer containing the elastomer with cavities has photoconductive properties.

8. The photoconductor according to claim 7, characterized in that the volume fraction of cavities in the layer containing the elastomer with cavities is from 9 to 95%, preferably from 20 to 80%.

9. Use of a photoconductor according to claim 6 in an electrophotographic, electrophotographic or magnetographic process and/or color printing process.

10. Use of an image carrier according to claim 1 in a method in which the transfer of the toner from the image carrier or photoconductor onto the printing substrate is effected thermally.

11. Process for producing an image having at least two colors on a substrate, said process comprising the steps of:

transferring a first color from a first image carrier on the substrate and transferring a second color from a second image carrier on the substrate;

wherein each of the first and second image carriers comprises (a) at least one elastomer with cavities (b) in a form selected from the group consisting of a solid drum, a rigid sleeve, a flexible sleeve, and a flexible tape.

* * * * *